US010856397B2

(12) United States Patent
Zhuang et al.

(10) Patent No.: US 10,856,397 B2
(45) Date of Patent: Dec. 1, 2020

(54) LIGHTING APPARATUS WITH WIRELESS MODULE

(71) Applicant: XIAMEN ECO LIGHTING CO. LTD., Xiamen (CN)

(72) Inventors: Jiaqing Zhuang, Xiamen (CN); Haipeng Xiao, Xiamen (CN); Zhiqing Chen, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/821,980

(22) Filed: Mar. 17, 2020

(65) Prior Publication Data

US 2020/0305260 A1 Sep. 24, 2020

Related U.S. Application Data

(60) Provisional application No. 62/820,043, filed on Mar. 18, 2019.

(51) Int. Cl.
*H05B 45/325* (2020.01)
*H05B 45/38* (2020.01)
*H05B 47/19* (2020.01)

(52) U.S. Cl.
CPC ..... *H05B 47/19* (2020.01); *H05B 45/325* (2020.01)

(58) Field of Classification Search
None
See application file for complete search history.

(56) References Cited

U.S. PATENT DOCUMENTS

2015/0250037 A1* 9/2015 Ido ..... H05B 45/3725 315/127

* cited by examiner

*Primary Examiner* — Henry Luong
(74) *Attorney, Agent, or Firm* — Chun-Ming Shih; Lanway IPR Services

(57) ABSTRACT

A lighting apparatus includes a LED (Light Emitted Diode) module, a wireless module, a rectifier, a first DC-DC (Direct Current to Direct Current) driver, a second DC-DC driver, a capacitor, a pre-charging circuit and a suppressing circuit. The first DC-DC driver converts the first DC power to a second DC power supplying to the LED module according to a PWM (Pulse Width Modulation) signal. The second DC-DC driver is used for converting the first DC power to a third DC power supplying to the wireless module. The capacitor is connected to the LED module in parallel for filtering the second DC power. The pre-charging circuit is used for pre-charging the capacitor in a stand-by mode. The wireless module receives the third DC power in the stand-by mode while the LED module is turned off in the stand-by mode.

12 Claims, 7 Drawing Sheets

LIGHTING APPARATUS WITH WIRELESS MODULE

RELATED APPLICATION

The present application claims priority of a provisional application No. 62/820,043.

FIELD

The present invention is related to a lighting apparatus and more particularly related to a lighting apparatus with a wireless module.

BACKGROUND

Lighting or illumination is the deliberate use of light to achieve a practical or aesthetic effect. Lighting includes the use of both artificial light sources like lamps and light fixtures, as well as natural illumination by capturing daylight. Daylighting (using windows, skylights, or light shelves) is sometimes used as the main source of light during daytime in buildings. This can save energy in place of using artificial lighting, which represents a major component of energy consumption in buildings. Proper lighting can enhance task performance, improve the appearance of an area, or have positive psychological effects on occupants.

Indoor lighting is usually accomplished using light fixtures, and is a key part of interior design. Lighting can also be an intrinsic component of landscape projects.

A light-emitting diode (LED) is a semiconductor light source that emits light when current flows through it. Electrons in the semiconductor recombine with electron holes, releasing energy in the form of photons. This effect is called electroluminescence. The color of the light (corresponding to the energy of the photons) is determined by the energy required for electrons to cross the band gap of the semiconductor. White light is obtained by using multiple semiconductors or a layer of light-emitting phosphor on the semiconductor device.

Appearing as practical electronic components in 1962, the earliest LEDs emitted low-intensity infrared light. Infrared LEDs are used in remote-control circuits, such as those used with a wide variety of consumer electronics. The first visible-light LEDs were of low intensity and limited to red. Modern LEDs are available across the visible, ultraviolet, and infrared wavelengths, with high light output.

Early LEDs were often used as indicator lamps, replacing small incandescent bulbs, and in seven-segment displays. Recent developments have produced white-light LEDs suitable for room lighting. LEDs have led to new displays and sensors, while their high switching rates are useful in advanced communications technology.

LEDs have many advantages over incandescent light sources, including lower energy consumption, longer lifetime, improved physical robustness, smaller size, and faster switching. Light-emitting diodes are used in applications as diverse as aviation lighting, automotive headlamps, advertising, general lighting, traffic signals, camera flashes, lighted wallpaper and medical devices.

Unlike a laser, the color of light emitted from an LED is neither coherent nor monochromatic, but the spectrum is narrow with respect to human vision, and functionally monochromatic.

The energy efficiency of electric lighting has increased radically since the first demonstration of arc lamps and the incandescent light bulb of the 19th century. Modern electric light sources come in a profusion of types and sizes adapted to many applications. Most modern electric lighting is powered by centrally generated electric power, but lighting may also be powered by mobile or standby electric generators or battery systems. Battery-powered light is often reserved for when and where stationary lights fail, often in the form of flashlights, electric lanterns, and in vehicles.

Although lighting devices are widely used, there are still lots of opportunity and benefit to improve the lighting devices to provide more convenient, low cost, reliable and beautiful lighting devices for enhancing human life.

SUMMARY

In some embodiments, a lighting apparatus includes a LED (Light Emitted Diode) module, a wireless module, a rectifier, a first DC-DC (Direct Current to Direct Current) driver, a second DC-DC driver, a capacitor, a pre-charging circuit and a suppressing circuit.

The rectifier is used for rectifying an AC (Alternating Current) input current to a first DC power. The first DC-DC driver converts the first DC power to a second DC power supplying to the LED module according to a PWM (Pulse Width Modulation) signal.

In electronics, an LED circuit or LED driver is an electrical circuit used to power a light-emitting diode (LED). The circuit must provide sufficient current supply (either DC or AC, see below) to light the LED at the required brightness, but must limit the current to prevent damaging the LED. The voltage drop across an LED is approximately constant over a wide range of operating current; therefore, a small increase in applied voltage greatly increases the current. Very simple circuits are used for low-power indicator LEDs. More complex, current source circuits are required when driving high-power LEDs for illumination to achieve correct current regulation.

The simplest circuit to drive an LED is through a series resistor. It is commonly used for indicators and digital displays in many consumer appliances, though this circuit is not particularly energy-efficient because energy is lost in the resistor.

An LED has a voltage drop specified at the intended operating current. Ohm's law and Kirchhoff's circuit laws are used to calculate the appropriate resistor value, by subtracting the LED voltage drop from the supply voltage and dividing by the desired operating current. With a sufficiently high supply voltage, multiple LEDs in series can be powered with one resistor.

If the supply voltage is close or equal to the LED forward voltage, then no reasonable value for the resistor can be calculated, so some other method of current limiting must be used.

The second DC-DC driver is used for converting the first DC power to a third DC power supplying to the wireless module.

The capacitor is connected to the LED module in parallel for filtering the second DC power. The pre-charging circuit is used for pre-charging the capacitor in a stand-by mode. The wireless module receives the third DC power in the stand-by mode while the LED module is turned off in the stand-by mode.

The suppressing circuit is connected to the pre-charging circuit for turning off the pre-charging circuit based on a reverse PWM signal opposite to the PWM signal. For example, when the PWM is at high level, the suppressing circuit generates a low level signal to turn off the pre-charging circuit for charging the capacitor.

In some embodiments, the capacitor used in IoT (Internet of Things) lighting devices may have more than 10 uF. Such capacitor may need time, causing delay, on turning on the LED modules. With the pre-charging circuit, the capacitor is kept at a higher loading level, decreasing reaction time for turning on the LED module.

In some embodiments, the pre-charging circuit includes a second resistor and a first transistor connected in series. The second resistor controls a necessary voltage level and the first transistor is used for determining whether to supply current to the capacitor to charge the capacitor.

In some embodiments, the pre-charging circuit keeps the capacitor at a stand-by loading level in the stand-by mode. In other words, the capacitor keeps certain amount of electronics in the capacitor. In such design, the response time of the capacitor is decreased to prevent undesired delay when turning on the LED module.

In some embodiments, the capacitor is charged to a working level from the stand-by loading level instead of from a zero level to increase startup time of the LED module.

In some embodiments, the suppressing circuit includes a second transistor connected to the PWM signal to generate a reversed signal opposite to the PWM signal to activate the pre-charging circuit in the stand-by mode.

In some embodiments, the suppressing circuit includes a third resistor, a fourth resistor and a fifth resistor. The fifth resistor is connected between a gate terminal of the second transistor and the PWM signal. The fourth resistor is connected between a voltage level and a source terminal of the second transistor. The third resistor is connected between a gate terminal of a first transistor of the pre-charging circuit and the source terminal of the second transistor.

In some embodiments, the lighting apparatus also includes a control module for controlling the first DC-DC driver based on a command received from the wireless module.

In some embodiments, the control module generates the PWM signal for controlling the first DC-DC driver.

In some embodiments, the control module generates the reverse PWM signal for selectively turning off the pre-charging circuit.

In some embodiments, the lighting apparatus also includes a plug slot for plugging the wireless module. The control module bypasses the capacitor when the wireless module is detected not working. For example, there is a status register setting to false when the plug slot is not inserted with a wireless module. When the control module checks the status register and determines a corresponding operation mode.

In some embodiments, the LED module has multiple sets with different optical characteristics. The wireless module converts an external command to control light mixing among the multiple sets of the LED module.

In some embodiments, the lighting apparatus also includes a tubular housing for enclosing the LED module.

In some embodiments, an antenna of the wireless module is attached on an external surface of the tubular housing. For example, the tubular housing may include a back cover and a light passing cover. The antenna may be attached to the back cover. In some other embodiments, the antenna may be made of transparent material and attached on the light passing cover.

In some embodiments, the lighting apparatus also includes a bulb housing for enclosing the LED module.

In some embodiments, the bulb housing has a cap with a manual switch for selectively deactivating the capacitor and the pre-charging circuit. For example, there is a sliding switch for selecting one mode from multiple choices which may correspond to different parameters like color temperatures.

In some embodiments, the lighting apparatus may also include a downlight housing for enclosing the LED module.

In some embodiments, the wireless module, the capacitor, and the pre-charging circuit are made as a module to be detachably attached to the downlight housing.

In some embodiments, the lighting apparatus may also include a fast LED module connected to a third DC-DC driver. The capacitor is not affecting operation of the third DC-DC driver and the fast LED module. In other words, the fast LED module is isolated from the LED module mentioned above and would not be affected by the capacitor. Therefore, there is a fast light startup, no need to wait for the capacitor to be full loaded, even the other LED module needs time to turn on.

In some embodiments, the fast LED module is turned on first and emits a higher level of light before the LED module is turned on.

In some embodiments, the first DC-DC driver and the second DC-DC driver are operated in different voltage levels. For example, the wireless module is operated under 3.3 V while the LED module is operated in a different voltage level.

DETAILED DESCRIPTION

There are various ways to implement the invention. Some examples are illustrated and explained as follows.

There are various lighting fixtures used in different places, including home use, factory use, factory use. LED is a critical technology in these years for bringing a revolution to the world of illuminance devices.

On the other hand, communication chips also have significant advancement in these years, including on cost, size, power consumption. Thus, there is a trend to incorporate IoT (Internet of Things) components to various lighting fixtures to convert traditional lighting fixtures as smart devices.

However, there are also various technical problems to be solved. For example, when a filter capacitor with up than 10 uF is required on both single level driver solution or linear driver solution, restarting of a smart lighting device after a soft switch off takes a long time, which causes bad user experience on such devices.

The same problem may also occur for hardware switch for products with memory mode. This problem is even worth when low cost components are selected.

Therefore, it is beneficial to develop a technical solution that solves the waiting time of restarting from low luminance level and improve starting function of a smart lighting devices.

Figure 1:
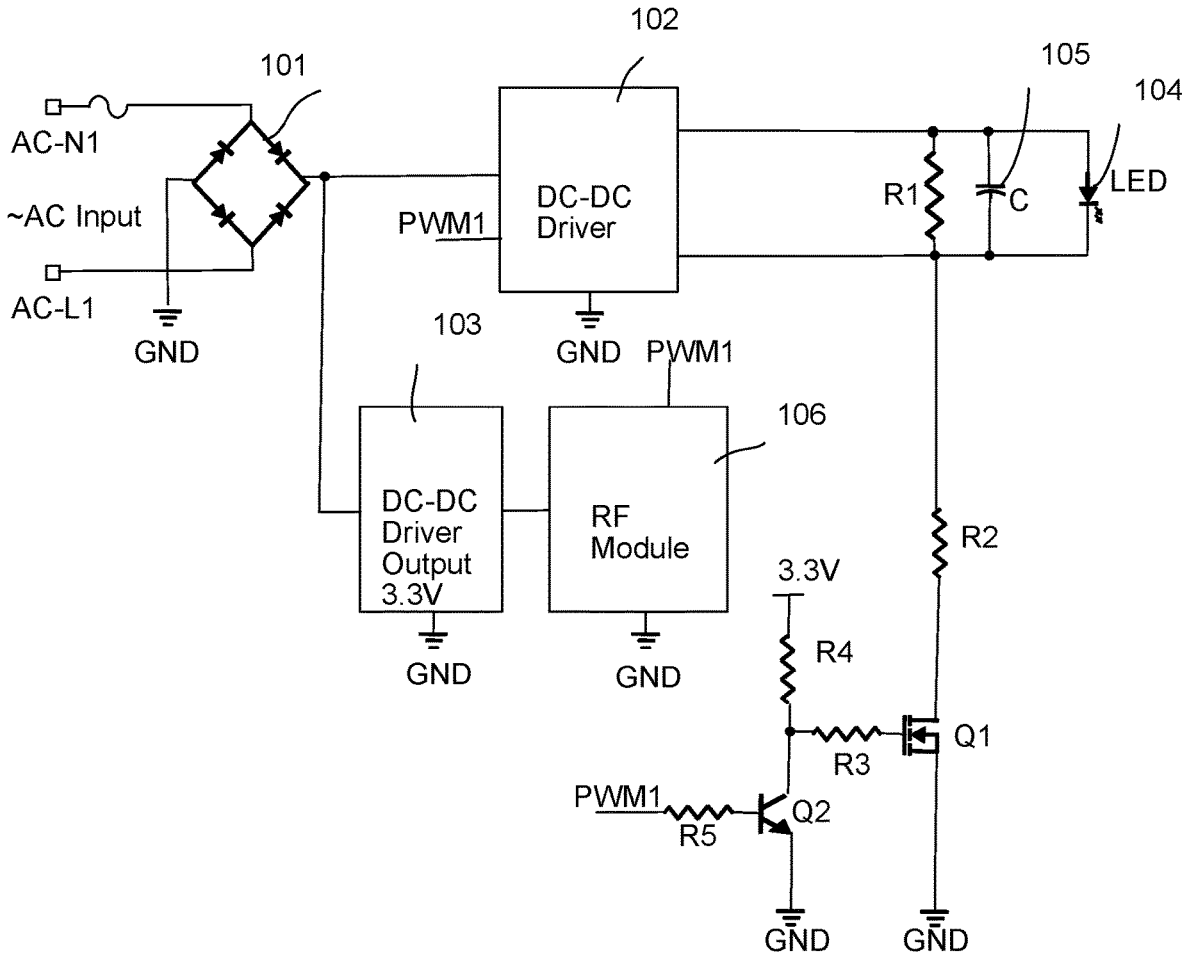
FIG. 1 is a circuit example of a lighting apparatus.

FIG. 1 illustrates an embodiment of a circuit diagram to solve such problem. In FIG. 1, four resistors R2, R3, R4, R5 are added. In addition, a transistor Q2, a MOS Q1 are also added, and connected as FIG. 1.

There is a bridge rectifier 101 for converting an AC power to a DC power. There is a first DC-DC driver 102 and a second DC-DC driver 103. The DC-DC driver 102 is used for supplying power to the LED module 104. There is a capacitor 105 connected in parallel with the LED module 104. There is also a resistor R1 connected in parallel with the capacitor 105.

The second DC-DC driver 103 is used for supplying power to the RF (Radio Frequency) module 106, which is an example of a wireless module.

There are two major aspects on the operation of the circuit diagram. In the first aspect, the resistor R2 and the MOS Q1, as the first transistor, forms a solution to keep the product to turn on the MOS Q1 during stand-by mode, and the resistors R1, R2 form a voltage division circuit to pre-charge the capacitor 103 so as to keep the capacitor 103 at a higher level value in soft turn-on or a circuit with hardware switch with memory mode. This helps decrease charging time and thus speed up the turning-on.

The second aspect is composed by the resistors R3, R4, R5 and the transistor Q2, as the second transistor, for generating a reverse PWM (Pulse Width Modulation), so that the first aspect only functions when stand-by to prevent affecting normal work of the light devices.

By charging the output capacitor via a divisional voltage from a mother line by the resistors, the output capacitor is kept at a higher output voltage. Therefore, when restarting, the output capacitor quickly reaches a conductive voltage to decrease turn-on time period of LED components.

Figure 2:
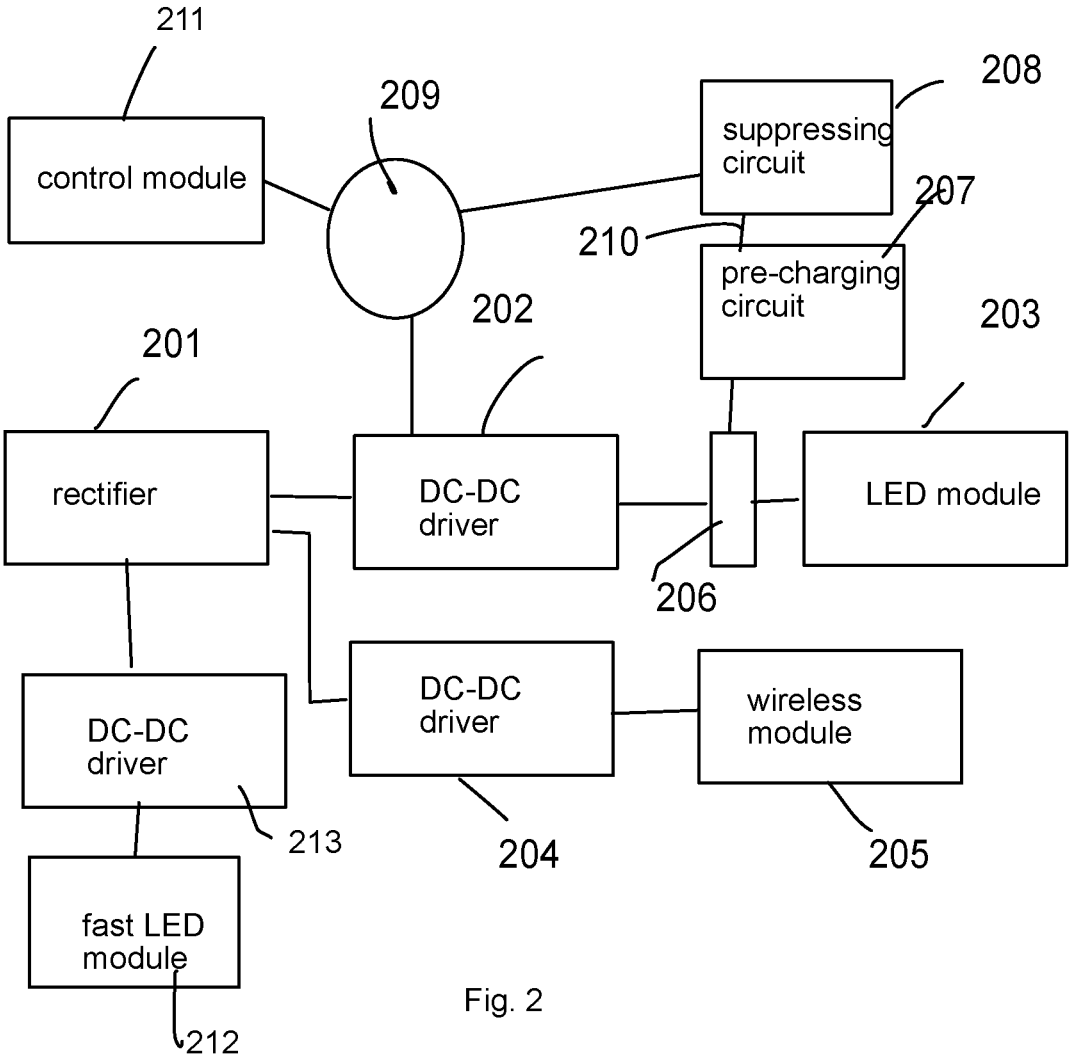
FIG. 2 is a diagram showing component relation in an embodiment.

In FIG. 2, a lighting apparatus includes a LED (Light Emitted Diode) module 203, a wireless module 205, a rectifier 201, a first DC-DC (Direct Current to Direct Current) driver 202, a second DC-DC driver 204, a capacitor 206, a pre-charging circuit 207 and a suppressing circuit 208.

The rectifier 201 is used for rectifying an AC (Alternating Current) input current to a first DC power. The first DC-DC driver 202 converts the first DC power to a second DC power supplying to the LED module 203 according to a PWM (Pulse Width Modulation) signal 209.

In electronics, an LED circuit or LED driver is an electrical circuit used to power a light-emitting diode (LED). The circuit must provide sufficient current supply (either DC or AC, see below) to light the LED at the required brightness, but must limit the current to prevent damaging the LED. The voltage drop across an LED is approximately constant over a wide range of operating current; therefore, a small increase in applied voltage greatly increases the current. Very simple circuits are used for low-power indicator LEDs. More complex, current source circuits are required when driving high-power LEDs for illumination to achieve correct current regulation.

The simplest circuit to drive an LED is through a series resistor. It is commonly used for indicators and digital displays in many consumer appliances, though this circuit is not particularly energy-efficient because energy is lost in the resistor.

An LED has a voltage drop specified at the intended operating current. Ohm's law and Kirchhoff's circuit laws are used to calculate the appropriate resistor value, by subtracting the LED voltage drop from the supply voltage and dividing by the desired operating current. With a sufficiently high supply voltage, multiple LEDs in series can be powered with one resistor.

If the supply voltage is close or equal to the LED forward voltage, then no reasonable value for the resistor can be calculated, so some other method of current limiting must be used.

The second DC-DC driver 204 is used for converting the first DC power to a third DC power supplying to the wireless module 205.

The capacitor 206 is connected to the LED module 203 in parallel for filtering the second DC power. The pre-charging circuit 207 is used for pre-charging the capacitor 206 in a stand-by mode. The wireless module 205 receives the third DC power in the stand-by mode while the LED module 203 is turned off in the stand-by mode.

The suppressing circuit 208 is connected to the pre-charging circuit 207 for turning off the pre-charging circuit 207 based on a reverse PWM signal 210 opposite to the PWM signal 209. For example, when the PWM is at high level, the suppressing circuit generates a low level signal to turn off the pre-charging circuit for charging the capacitor.

In some embodiments, the capacitor used in IoT (Internet of Things) lighting devices may have more than 10 uF. Such capacitor may need time, causing delay, on turning on the LED modules. With the pre-charging circuit, the capacitor is kept at a higher loading level, decreasing reaction time for turning on the LED module.

In some embodiments, the pre-charging circuit includes a second resistor and a first transistor connected in series, as illustrated in the example of FIG. 1. The second resistor controls a necessary voltage level and the first transistor is used for determining whether to supply current to the capacitor to charge the capacitor.

In some embodiments, the pre-charging circuit keeps the capacitor at a stand-by loading level in the stand-by mode. In other words, the capacitor keeps certain amount of electronics in the capacitor. In such design, the response time of the capacitor is decreased to prevent undesired delay when turning on the LED module.

In some embodiments, the capacitor is charged to a working level from the stand-by loading level instead of from a zero level to increase startup time of the LED module.

In some embodiments, the suppressing circuit includes a second transistor connected to the PWM signal to generate a reversed signal opposite to the PWM signal to activate the pre-charging circuit in the stand-by mode.

As illustrated in FIG. 1, the suppressing circuit includes a third resistor, a fourth resistor and a fifth resistor. The fifth resistor is connected between a gate terminal of the second transistor and the PWM signal. The fourth resistor is connected between a voltage level and a source terminal of the second transistor. The third resistor is connected between a gate terminal of a first transistor of the pre-charging circuit and the source terminal of the second transistor.

In some embodiments, the lighting apparatus also includes a control module 211 as illustrated in FIG. 2 for controlling the first DC-DC driver based on a command received from the wireless module.

In FIG. 2, the control module 211 generates the PWM signal 209 for controlling the first DC-DC driver 202.

In some embodiments, the control module generates the reverse PWM signal for selectively turning off the pre-charging circuit.

Figure 3:
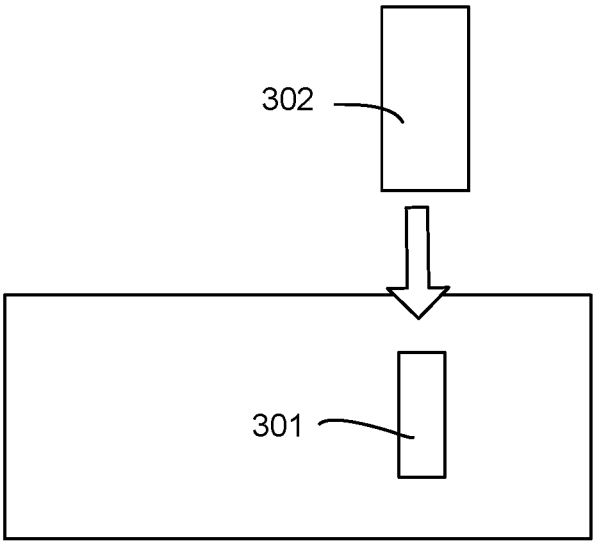
FIG. 3 shows a plugging wireless module.

In FIG. 3, the lighting apparatus also includes a plug slot 301 for plugging the wireless module 302. The control module bypasses the capacitor when the wireless module 302 is detected not working. For example, there is a status register setting to false when the plug slot is not inserted with a wireless module. When the control module checks the status register and determines a corresponding operation mode.

Figure 4:
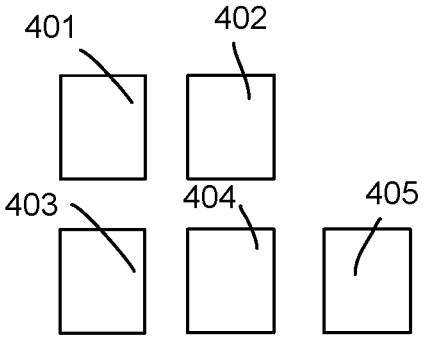
FIG. 4 shows a LED module with multiple sets having different parameters.

In FIG. 4, the LED module has multiple sets with different optical characteristics. The wireless module converts an external command to control light mixing among the multiple sets of the LED module. For example, the LED set 401 emits a first white light, the LED set 402 emits a second white light with a different color temperature as the first LED set 401. There are also a red LED set 403, a blue LED set 404 and a green LED set 405.

Figure 5:
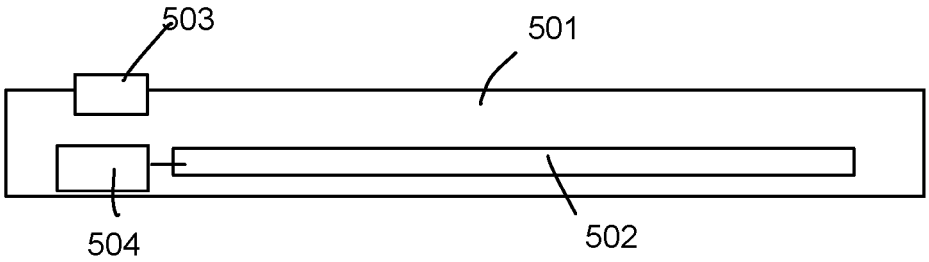
FIG. 5 shows a light tube example.

In FIG. 5, the lighting apparatus also includes a tubular housing 501 for enclosing the LED module 502.

In FIG. 5, an antenna 503 of the wireless module 504 is attached on an external surface of the tubular housing 501. For example, the tubular housing may include a back cover and a light passing cover. The antenna may be attached to the back cover. In some other embodiments, the antenna may be made of transparent material and attached on the light passing cover.

Figure 6:
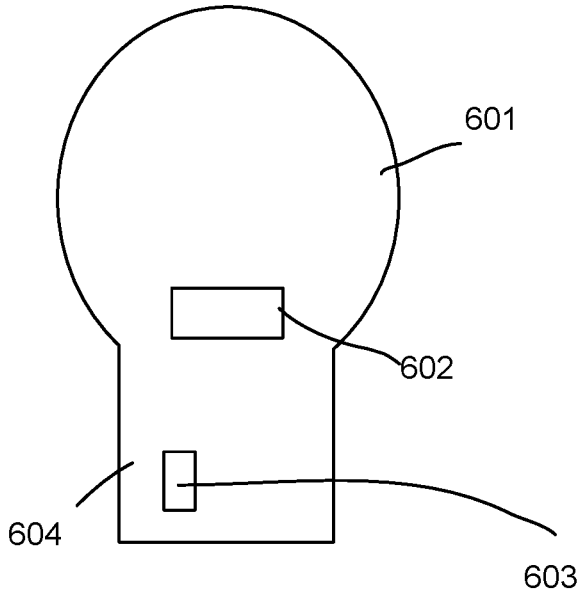
FIG. 6 shows a bulb example.

In FIG. 6, the lighting apparatus also includes a bulb housing 601 for enclosing the LED module 602.

In FIG. 6, the bulb housing has a cap 604 with a manual switch 603 for selectively deactivating the capacitor and the pre-charging circuit. For example, there is a sliding switch for selecting one mode from multiple choices which may correspond to different parameters like color temperatures.

Figure 7:
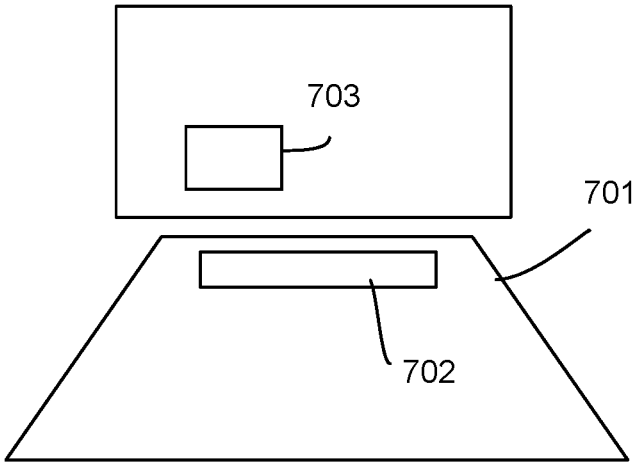
FIG. 7 shows a downlight example.

In FIG. 7, the lighting apparatus may also include a downlight housing 701 for enclosing the LED module 702.

In FIG. 7, the wireless module, the capacitor, and the pre-charging circuit are made as a module 703 to be detachably attached to the downlight housing.

In FIG. 2, the lighting apparatus may also include a fast LED module 212 connected to a third DC-DC driver 213. The capacitor is not affecting operation of the third DC-DC driver 213 and the fast LED module 212. In other words, the fast LED module 212 is isolated from the LED module 203 and would not be affected by the capacitor. Therefore, there is a fast light startup, no need to wait for the capacitor to be full loaded, even the other LED module needs time to turn on.

In some embodiments, the fast LED module is turned on first and emits a higher level of light before the LED module is turned on.

In some embodiments, the first DC-DC driver and the second DC-DC driver are operated in different voltage levels. For example, the wireless module is operated under 3.3 V while the LED module is operated in a different voltage level.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a LED module;

a wireless module;

a rectifier for rectifying an AC input current to a first DC power;

a first DC-DC driver for converting the first DC power to a second DC power supplying to the LED module according to a PWM signal;

a second DC-DC driver for converting the first DC power to a third DC power supplying to the wireless module;

a capacitor connected to the LED module in parallel for filtering the second DC power;

a pre-charging circuit for pre-charging the capacitor in a stand-by mode, the wireless module receiving the third DC power in the stand-by mode while the LED module being turned off in the stand-by mode; and a suppressing circuit connected to the pre-charging circuit for turning off the pre-charging circuit based on a reverse PWM signal opposite to the PWM signal;

wherein the pre-charging circuit comprises a second resistor and a first transistor connected in series; and wherein the suppressing circuit comprises a second transistor connected to the PWM signal to generate a reversed signal opposite to the PWM signal to activate the pre-charging circuit in the stand-by mode; and wherein the suppressing circuit comprises a third resistor, a fourth resistor and a fifth resistor, the fifth resistor is connected between a gate terminal of the second transistor and the PWM signal, the fourth resistor is connected between a voltage level and a source terminal of the second transistor, the third resistor is connected between a gate terminal of a first transistor of the pre-charging circuit and the source terminal of the second transistor.

2. The lighting apparatus of claim 1, wherein the pre-charging circuit keeps the capacitor at a stand-by loading level in the stand-by mode.

3. The lighting apparatus of claim 2, wherein the capacitor is charged to a working level from the stand-by loading level instead of from a zero level to increase startup time of the LED module.

4. The lighting apparatus of claim 1, wherein the LED module has multiple sets with different optical characteristics, the wireless module converts an external command to control light mixing among the multiple sets of the LED module.

5. The lighting apparatus of claim 1, further comprising a tubular housing for enclosing the LED module.

6. The lighting apparatus of claim 5, wherein an antenna of the wireless module is attached on an external surface of the tubular housing.

7. The lighting apparatus of claim 1, further comprising a bulb housing for enclosing the LED module.

8. The lighting apparatus of claim 1, further comprising a downlight housing for enclosing the LED module.

9. The lighting apparatus of claim 8, wherein the wireless module, the capacitor, and the pre-charging circuit are made as a module to be detachably attached to the downlight housing.

10. The lighting apparatus of claim 1, further comprising a fast LED module connected to a third DC-DC driver, the capacitor is not affecting operation of the third DC-DC driver and the fast LED module.

11. The lighting apparatus of claim 10, wherein the fast LED module is turned on first and emits a higher level of light before the LED module is turned on.

12. The lighting apparatus of claim 1, wherein the first DC-DC driver and the second DC-DC driver are operated in different voltage levels.

* * * * *